US006513195B2

(12) United States Patent
Haase et al.

(10) Patent No.: US 6,513,195 B2
(45) Date of Patent: Feb. 4, 2003

(54) HINGE FOR A CONTAINER

(75) Inventors: Thomas Haase, Lübeck (DE); Helmut Holtmann, Stockelsdorf (DE); Axel Mummert, Lübeck (DE); Katja Nicke, Lübeck (DE); Ute Ollmann, Ratzeburg (DE); Siegfried Preiniger, Stockelsdorf (DE); Wolfgang Specht, Wahlstedt (DE)

(73) Assignee: Dräger Medizintechnik GmbH (DE)

( * ) Notice: Subject to any disclaimer, the term of this patent is extended or adjusted under 35 U.S.C. 154(b) by 0 days.

(21) Appl. No.: 09/850,327

(22) Filed: May 7, 2001

(65) Prior Publication Data

US 2001/0052168 A1 Dec. 20, 2001

(30) Foreign Application Priority Data

May 8, 2000 (DE) ..... 100 21 899

(51) Int. Cl.[7] ..... E05D 7/00; E05D 11/06; B65D 43/24

(52) U.S. Cl. ..... 16/266; 220/832

(58) Field of Search ..... 16/257, 266, 268, 16/262; 220/810, 831, 832

(56) References Cited

U.S. PATENT DOCUMENTS

| | | | | | |
|---|---|---|---|---|---|
| 3,425,587 | A | * | 2/1969 | Duross, Jr. | 220/831 |
| 3,663,990 | A | | 5/1972 | Shane | 16/269 |
| 4,441,637 | A | * | 4/1984 | Libit | 220/832 |
| 4,584,589 | A | * | 4/1986 | Bivins et al. | 16/358 |
| 4,976,373 | A | * | 12/1990 | Perdue et al. | 220/832 |
| 5,054,723 | A | * | 10/1991 | Arnold | 16/319 |
| 5,141,124 | A | * | 8/1992 | Smith et al. | 220/831 |

* cited by examiner

*Primary Examiner*—Thomas B. Will
*Assistant Examiner*—Tara L. Mayo
(74) *Attorney, Agent, or Firm*—McGlew and Tuttle, P.C

(57) ABSTRACT

A hinge is provided at an edge of a container and a cover of the container. The hinge is designed such that the edge of the container can be both lifted off from the edge of the container and folded away. The pivoting movement of a second member (4) is limited by two stop positions I and II, of which the stop position I defines a stable position of the cover of the container on the edge of the container, fixed by the inner part (8) and the outer part (9). The closed container can be opened from the stop position I by lifting off the cover of the container, and the other stop position II defines a stable position of the cover of the container folded away from the edge of the container with the container opened, likewise fixed by the inner part (8) and the outer part (9).

9 Claims, 4 Drawing Sheets

HINGE FOR A CONTAINER

FIELD OF THE INVENTION

The present invention pertains to a hinge between an edge of a container and a cover of a container.

BACKGROUND OF THE INVENTION

Hinges have been known which make it possible both to open the cover of a container and to remove the cover from a container. Such a hinge is described in U.S. Pat. No. 3,663,990. This hinge comprises a longitudinal groove designed as an inner guide surface on an edge of the container and an edge of a cover engaging the groove, so that the cover can be pivoted over a preset angle range, can be locked in the opened position and can be removed from the edge of the container. The hinge is designed for a cover that is arranged in the horizontal direction, preferably for a lighting arrangement. The cover is therefore removed from the edge of the container by unhooking the edge of the cover from the groove of the container.

Such hinges are suitable, in principle, for all containers that can be closed with a cover. The drawback in the case of containers that require frequent and simple removal of the corresponding cover is that the unhooking from the edge of the container must be performed at the time of the removal of the cover.

SUMMARY AND OBJECTS OF THE INVENTION

The object of the present invention is to provide a hinge for the interaction of a container with a corresponding cover during the opening and closing of the container, which makes possible both the opening of the cover on the container and the simple and rapid removal of the cover from the container.

According to the invention, a hinge between an edge of a container and a cover of a container is provided, comprising a first member at the edge of the container with a receiving depression, which has an inner guide surface, and a second member, which is provided as a projection on the cover of the container and engages the depression (2) of the first member. The said second member can perform a pivoting movement relative to the first member along the inner guide surface. On opposite sides of the inner guide surface, the edge of the container has an inner part and an outer part, which limit the pivoting movement of the second member along the inner guide surface by two stop positions I and II. The second member lies on the inner part of the edge of the container in the stop position I and is secured by the outer part against slipping laterally in relation to the edge of the container. The second member is clamped between the inner part and the outer part of the edge of the container in the stop position II by being pressed downward by the inner part and by being supported from below on the rear side by the outer part.

The fact that the cover of the container can be removed by being simply lifted from the edge of the container and the container can thus be opened is an advantage of the hinge according to the present invention. However, if removal of the cover of the container is required to make accessible the interior of the container from the outside, the hinge makes it possible to fold away the cover of the container and thus to leave the cover on the opened container.

According to a preferred embodiment, a locked position is created, in which the cover of the container is fixed relative to the edge of the container. This may be advantageous, e.g., when a stable position of the container shall be brought about in the half-opened state.

The hinge comprises two members. In a special embodiment, the first member has a depression with a lip and the second member has a widening end piece, which engage one another such that the two members are secured against slipping out of one another or displacement in relation to one another, especially during the pivoting of the cover in relation to the edge of the container.

The hinge according to the present invention is suitable for a great variety of containers. In an advantageous embodiment, a plurality of such hinges are distributed over an edge of the container, so that the cover of the container can be folded away from the edge of the container in different directions, from which the opened container will then be accessible.

The simple access to the interior of the container both by simply lifting off the cover of the container and folding away the cover of the container from the edge of the container in a desired direction is especially advantageous in incubators for premature or newborn patients in which simple and rapid access to the patient from different sides is necessary for care or supply measures, and, on the other hand, the reclosing of the incubator must also take place rapidly in order to preserve the climate in the interior of the incubator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
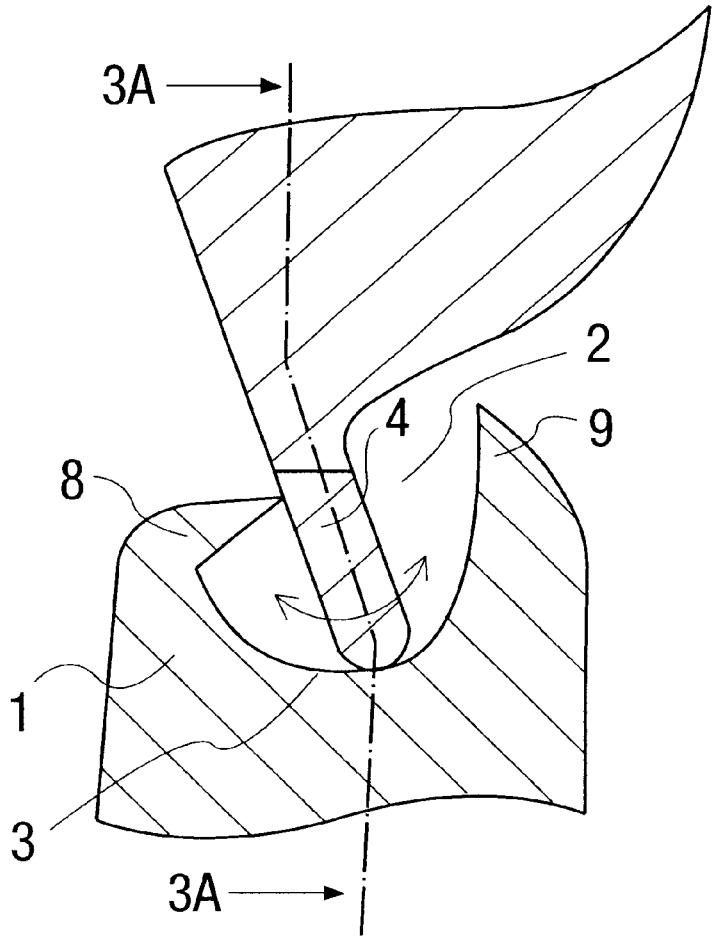
FIG. 1 is a lateral cross sectional view of a hinge according to the present invention.

Referring to the drawings in particular, the figures show the hinge according to the invention schematically. The shaded areas on section planes are not shown for the sake of greater clarity.

The hinge in FIG. 1 comprises a first member 1 and a second member 4. The first member 1 is located on an edge of the container and has a receiving depression 2 with an inner guide surface 3. The second member 4 is designed as a projection on a container cover.

Figure 1A:
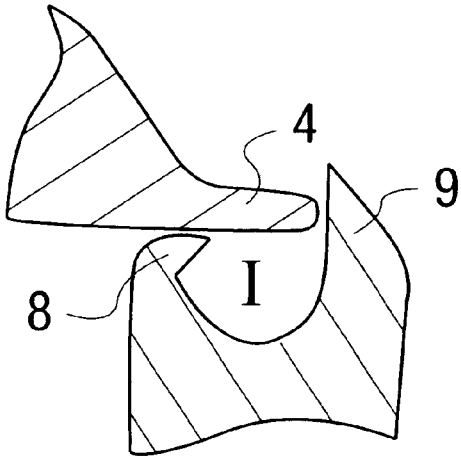
FIG. 1*a* is a lateral cross sectional view of the hinge of FIG. 1 with the container closed.
Figure 1B:
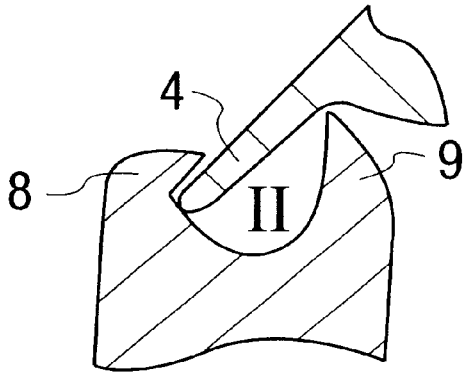
FIG. 1*b* is a lateral cross sectional view of the hinge from FIG. 1 with the container opened.

The edge of the container and the cover of the container cooperate during the opening and closing of the corresponding container by the second member 4 engaging the depression 2 of the first member 1 and performing a pivoting movement relative to the first member 1 along the inner guide surface 3, represented by a double arrow. The pivoting movement of the second member 4 is limited by the stop position I, shown in FIG. 1*a*, and by the stop position II, shown in FIG. 1*b*. The stop position I designates a stable position of the cover of the container on the edge of the container with the container closed.

The second member 4 lies on the inner part 8 of the edge of the container and is secured by the outer part 9 against a lateral slipping in relation to the edge of the container. Removal of the cover of the container from the edge of the container by lifting off the cover of the container vertically upward is possible in stop position I. Stop position II designates a stable position of the container cover folded away from the edge of the container with the container opened. The second member 4 presses the inner part 8 of the edge of the container obliquely from below, while it is supported on the rear side from the same direction by the outer part 9 of the edge of the container. The second member 4 is thus stabilized, as is the entire container cover, on which the second member 4 is provided as a projection.

Figure 2:
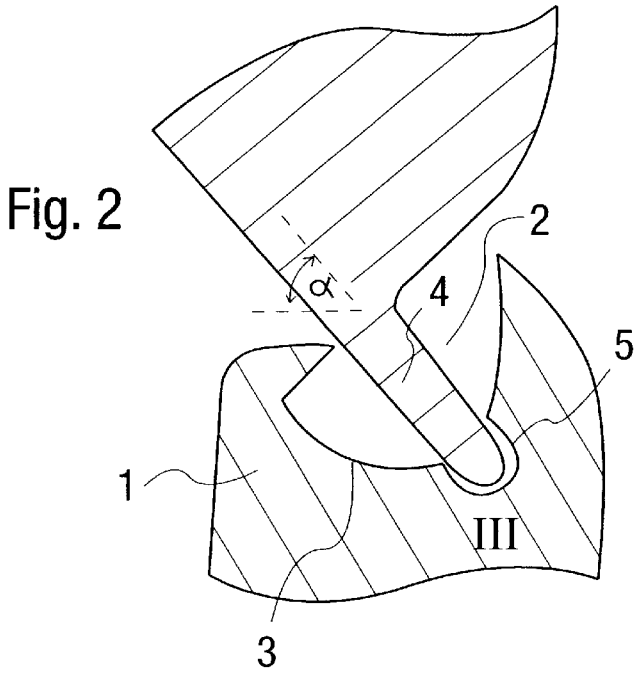
FIG. 2 is a lateral cross sectional view of a preferred embodiment of the hinge according to the present invention, in which a locked position of the cover of the container is provided in the half-opened state of the container.

FIG. 2 shows a lateral cross section of a preferred embodiment of the hinge according to the present invention. The inner guide surface 3 of the depression 2 of the first member 1, which said depression receives the said second member 4, has another depression 5, into which the second member 4 can snap at its end in a positive-locking manner. A locked position III of the second member 4 relative to the first member 1 is thus generated. Depending on the position of the depression 5 in the guide surface 3, the locked position III fixes the cover of the container at an angle a relative to the edge of the container. A locked position III with the cover of the container half opened corresponds to an angle of approx. $\alpha$=45°.

Figure 3A:
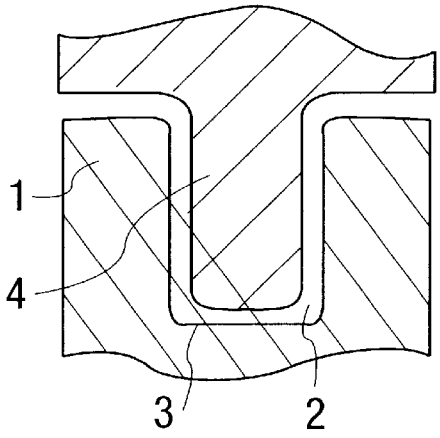
FIG. 3*a* is a cross sectional view along line A—A in FIG. 1 at right angles to the cross section in FIG. 1, showing the hinge according to the present invention.
Figure 3B:
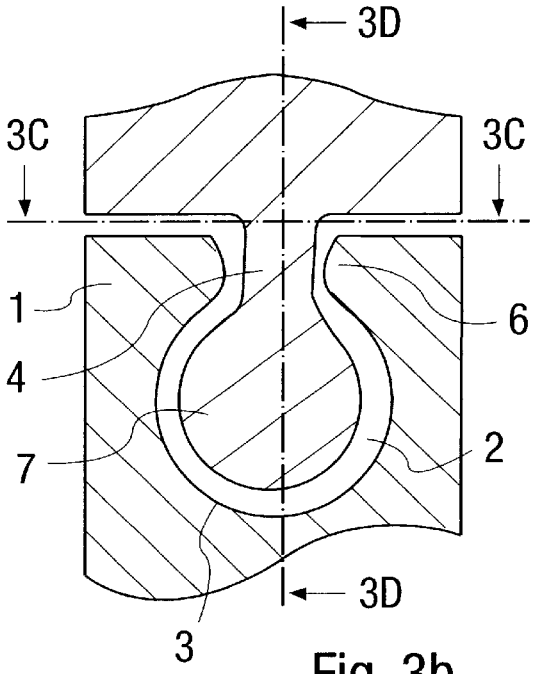
FIG. 3*b* is a view of a preferred hinge embodiment with a lip and expanding end piece showing a view similar to the view of FIG. 3*a;*

FIGS. 3*a* and 3*b* show a hinge each in a cross section along line A—A in FIG. 1 at right angles to the cross section in FIG. 1. FIG. 3*b* shows a preferred embodiment of the hinge with a first member 1, whose receiving depression 2 has a contracting lip 6 toward the edge, which lip leads to a narrowing at the edge of the depression 2. The second member 4 engaging the depression 2 has an expanding end piece 7. Relative to the cross section shown in FIG. 3*b*, the depression 2 with the contracting lip 6 and the second member 4 with the expanding end piece 7 engage one another in a positive-locking manner. The second member 4 is prevented from slipping by the expanding end piece 7 now being blocked by the contracting lip 6.

Figure 3C:
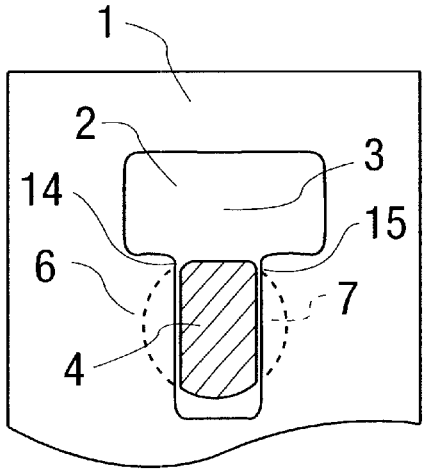
FIG. 3*c* is a cross sectional view along line B—B in FIG. 3*b* at right angles to the cross section in FIG. 3*b* showing the hinge from FIG. 3*b;*

FIG. 3*c* shows the hinge from FIG. 3*b* in a cross section along line B—B in FIG. 3*b* at right angles to the cross section in FIG. 3*b*. The contracting lip 6 with two tongues 14 and 15 is provided on only part of the edge of the depression 2. The second member 4 is prevented from slipping out of the depression 2 of the first member 1 during the pivoting movement and in the stop position II with the container opened by the contracting lip 6, which blocks the expanding end piece 7 of the second member 4. The distance between the two tongues 14 and 15 is selected to be such that the second member 4 can be introduced into the tongues 14 and 15 and the external diameter of the expanding end piece 7 is greater than the clearance between the tongues 14 and 15. The contracting lip 6, which is provided only partially at the edge of the depression 2, no longer blocks the expanding end piece 7 in the stop position I with the container closed. The cover of the container can therefore be lifted off from the edge of the container without resistance in stop position I.

Figure 3D:
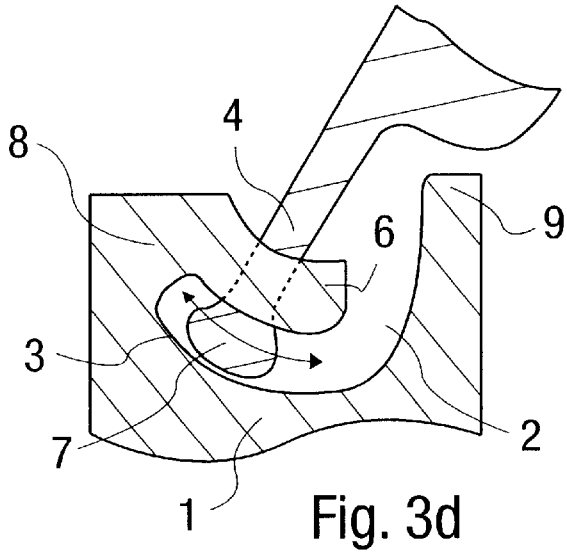
FIG. 3*d* is a cross sectional view along line C—C in FIG. 3*b* at right angles to the cross section in FIG. 3*b* showing the hinge from FIG. 3*b;*

FIG. 3*d* shows the hinge from FIG. 3*b* in a cross section along line C—C in FIG. 3*b* at right angles to the cross section in FIG. 3*b*. The second member 4 with the expanding end piece 7 performs a pivoting movement relative to the first member 1 along the inner guide surface 3 with the contracting lip 6, shown by a double arrow. It can be recognized here as well that the contracting lip 6 blocks the expanding end piece 7 during pivoting movement and in the stop position II with the container opened. The expanding end piece 7 is no longer blocked in stop position I with the container closed because the contracting lip 6 is provided only partially at the edge of the depression 2, which receives the second member 4 with the expanding end piece 7.

Figure 4A:
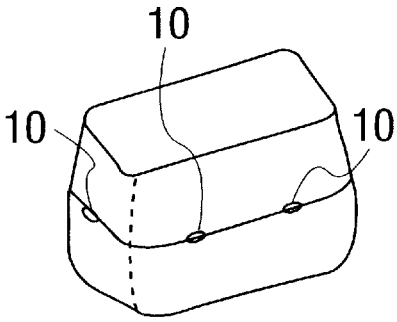
FIG. 4*a* is a perspective view of a container with hinges according to the present invention.
Figure 4B:
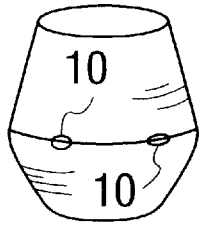
FIG. 4*b* is a perspective view of another container with hinges according to the present invention.

FIGS. 4*a* and 4*b* show containers with hinges 10 according to the present invention, which may have, e.g., a rectangular, round or oval horizontal projection, in the closed state.

Figure 4C:
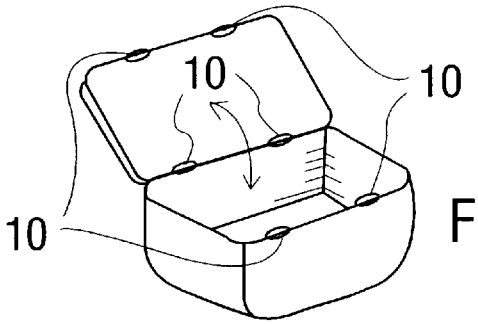
FIG. 4*c* is a perspective view of a container with hinges according to the present invention.

FIG. 4*c* shows a container opened by folding open at one of the hinges 10.

Figure 5A:
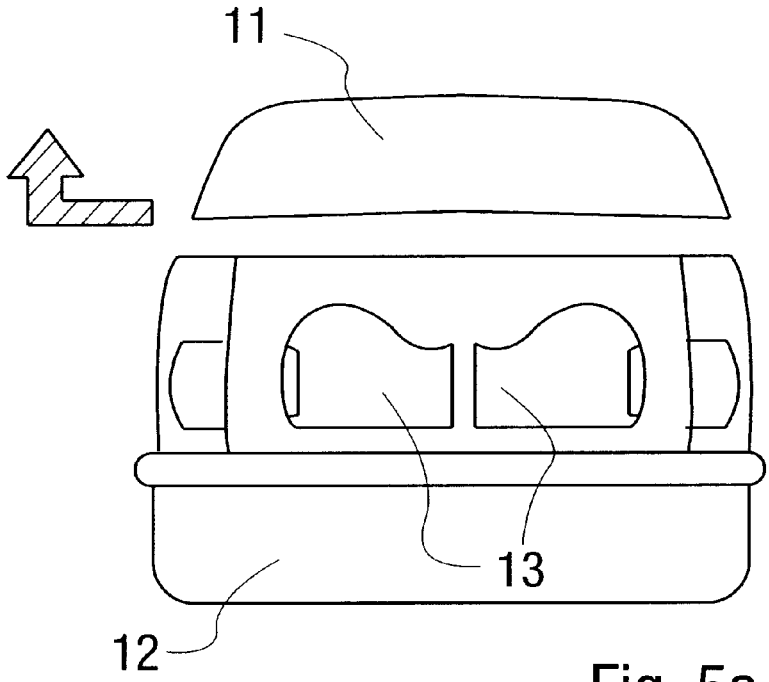
FIG. 5*a* is a side view of an incubator opened by lifting off the incubator cover.

FIG. 5*a* shows an incubator for premature or newborn patients in a side view of the longitudinal side. The patient is located on the reclining surface 12; access to the patient is also possible through the manipulating openings 13, besides via the lifted-off incubator cover 11.

Figure 5B:
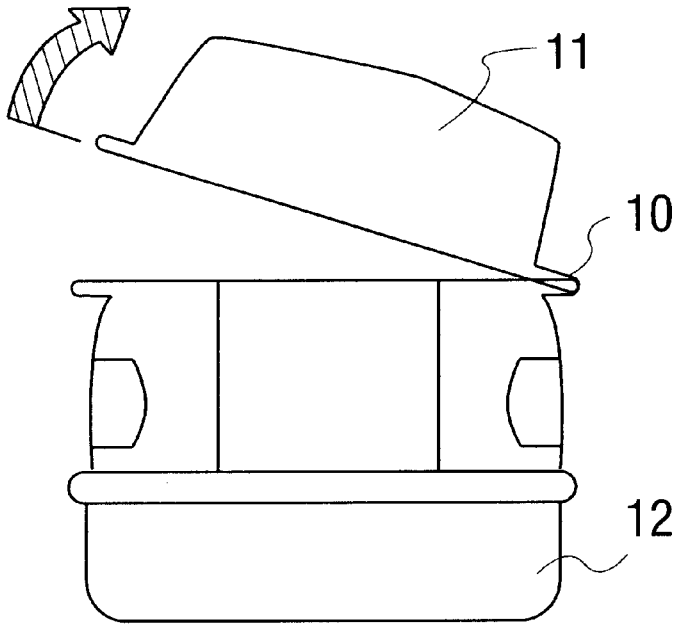
FIG. 5*b* is a side view of an incubator opened by folding open the incubator cover.

FIG. 5*b* shows the incubator from FIG. 5*a* in the view of the head side at right angles to the view in FIG. 5*a*. The incubator cover 11 is folded open at the hinge 10.

It is useful to arrange two hinges 10 each on the two longitudinal sides of the incubator, as is shown as an example in FIG. 4*c*.

The hinges 10 on the front side of the incubator are not shown in FIGS. 5*a* and 5*b* for the sake of greater clarity.

While specific embodiments of the invention have been shown and described in detail to illustrate the application of the principles of the invention, it will be understood that the invention may be embodied otherwise without departing from such principles.

What is claimed is:

1. A hinge between an edge of a container and a cover of a container, comprising:

a first member at the edge of the container with a receiving depression having an inner guide surface, said receiving depression being open at a cover side;

a second member as a projection on the cover of the container, said projection engaging said receiving depression through said opening at said cover side of said first member, said second member being pivotable with said projection being movable relative to said first member along said inner guide surface, the edge of the container having an inner part and an outer part on opposite sides of said inner guide surface, said inner part and said outer part limiting pivoting movement of said second member along said inner guide surface by two stop positions, said second member engaging said inner part in a first of said stop positions and said second member being secured by said outer part against slipping laterally in relation to the edge of the container and said second member being clamped between said inner part and said outer part of the edge of the container in a second of said stop positions by being engaged by said inner part and by being supported from below on a rear side by said outer part.

2. A hinge in accordance with claim 1, wherein said inner guide surface has at least one additional depression for receiving said second member, said additional depression forming a locked position of said second member relative to said first member.

3. A hinge in accordance with claim 1, wherein said receiving depression at the edge has at least partially a contracting lip having a fork-shape with two tongues and said second member has a dimension that expands in one direction, wherein a distance between said two tongues is selected to be such that said second member can be introduced between said tongues and an external diameter of said second member is greater than a clearance of said tongues.

4. A container, comprising:

a main container part with an edge having a receiving depression with an inner guide surface, the receiving depression having an opening on a cover side;

a container cover with a projection engaging said receiving depression through said opening on said cover side, said cover being pivotable relative to said main container part with said projection movable along said inner guide surface, the edge of the main container part having an inner part and an outer part on opposite sides of the said inner guide surface, said inner part and said outer part limiting pivoting movement of said projection along said inner guide surface by two stop positions, said projection lying on the inner part of the edge of said container in a first of said stop positions and said projection being secured by said outer part against slipping laterally in relation to the edge of the container and said projection being clamped between said inner part and said outer part of the edge of the container main part in a second of said stop positions by being engaged by said inner part and by being supported from below on a rear side by said outer part.

5. A container in accordance with claim 4, wherein the container is an incubator for premature or newborn patients.

6. A container, comprising:

a main container part with an edge having a recess extending from a cover side of the container into the edge of the container, the recess having an inner guide surface;

a container cover with a projection extending into a region of said recess from said cover side and engaging said guide surface, said cover being pivotable relative to said main container part with said projection movable along said inner guide surface, the edge of the main container part having an inner side part and an outer side part on opposite sides of the said inner guide surface, said inner side part and said outer side part limiting pivoting movement of said projection along said inner guide surface by two stop positions, said projection lying on the inner part of the edge of said container in a first of said stop positions and said projection being held by said outer part against slipping laterally in relation to the edge of the container and said projection being held in a position between said inner side part and said outer side part of the edge of the container main part in a second of said stop positions by being engaged by said inner side part and by being supported from below on a rear side by said outer side part.

7. A container in accordance with claim 6, wherein the container is an incubator for premature or newborn patients.

8. A hinge in accordance with claim 6, wherein said inner guide surface has at least one additional recess for receiving said projection, said additional recess forming a locked position of said projection relative to said first member.

9. A hinge in accordance with claim 6, wherein said receiving recess at the edge has at least partially a contracting lip having a fork-shape with two tongues and said projection has a dimension that varies in one direction and a distance between said two tongues is selected to be such that said projection can be introduced between said tongues and an external diameter of said projection is greater than a clearance of said tongues.

* * * * *